US006997602B2

(12) United States Patent
Mojon et al.

(10) Patent No.: US 6,997,602 B2
(45) Date of Patent: Feb. 14, 2006

(54) CONSTANT-FORCE DEVICE FOR INDIRECT-SECOND WATCHES

(75) Inventors: Jean-François Mojon, Les Hauts-Geneveys (CH); Kilian Eisenegger, Stetten (CH)

(73) Assignee: Richemont International S.A., Villars-Sur-Glane (CH)

( * ) Notice: Subject to any disclaimer, the term of this patent is extended or adjusted under 35 U.S.C. 154(b) by 139 days.

(21) Appl. No.: 10/693,902

(22) Filed: Oct. 28, 2003

(65) Prior Publication Data

US 2004/0156273 A1 Aug. 12, 2004

(30) Foreign Application Priority Data

Feb. 10, 2003 (EP) ..... 03002887

(51) Int. Cl.
*G04B 15/00* (2006.01)

(52) U.S. Cl. ..... 368/127; 368/132

(58) Field of Classification Search ..... 368/124, 368/127, 128, 132
See application file for complete search history.

(56) References Cited

U.S. PATENT DOCUMENTS

| | | | | |
|---|---|---|---|---|
| 416,804 A | | 12/1889 | Prentiss | |
| 975,959 A | | 11/1910 | Kangas | |
| 2,663,139 A | * | 12/1953 | Fink | 368/132 |
| 2,958,180 A | * | 11/1960 | Marti et al. | 368/129 |
| 3,125,890 A | * | 3/1964 | Dillon | 74/125.5 |
| 3,286,454 A | * | 11/1966 | Wustenhagen et al. | 368/65 |
| 6,814,483 B1 | * | 11/2004 | Watanabe et al. | 368/127 |
| 6,863,434 B1 | * | 3/2005 | Mojon | 368/127 |
| 2002/0114225 A1 | | 8/2002 | Damasko | |
| 2004/0218473 A1 | * | 11/2004 | Takahashi et al. | 368/37 |

FOREIGN PATENT DOCUMENTS

| | | |
|---|---|---|
| CH | 416804 | 12/1889 |
| CH | 98828 | 5/1923 |
| CH | 120028 | 7/1926 |
| CH | 164 247 A | 9/1933 |
| CH | 166265 | 3/1934 |
| CH | 223109 | 11/1942 |
| CH | 244096 | 2/1947 |
| CH | 353679 | 5/1961 |
| EP | 0 018 796 A2 | 11/1980 |
| EP | 1 045 297 A1 | 10/2000 |
| EP | 1 319 997 A1 | 6/2003 |

OTHER PUBLICATIONS

Richard Meis, "Eine Uhrmacherdynastie aus Dresden," 1999, pp. 127-129, 235, and 166-168.

* cited by examiner

*Primary Examiner*—Andrew H. Hirshfeld
*Assistant Examiner*—Leo T. Hinze
(74) *Attorney, Agent, or Firm*—Young & Thompson

(57) ABSTRACT

The present invention refers to a constant-force device suitable for being integrated into a movement of watches, particularly wrist watches, with an indirect-second mechanism having an intermediate second pinion (14) driven by a second wheel (9) of the movement, and an indirect-second wheel (15). The constant-force device comprises a tensioning module (4, 5, 6, 7, 8), a cam (2), a lever (11), and a stop wheel (13). The stop wheel (13) of the constant-force device is mounted on the intermediate second pinion (14) of the indirect-second mechanism.

11 Claims, 2 Drawing Sheets

B
C
R
I
II

CONSTANT-FORCE DEVICE FOR INDIRECT-SECOND WATCHES

BACKGROUND OF THE INVENTION

The present invention refers to a constant-force device for watches, particularly for wrist watches, having an indirect-second mechanism.

DESCRIPTION OF THE RELATED ART

While the principles of constant-force mechanisms have long been known, and have also been realized in many variants of such mechanisms, as a rule such mechanisms are always redesigned from the beginning for any specific application or given watch movement. This implies at the same time that in view of their specific design concept, these mechanisms will only serve this specific purpose and hence are highly limited in their applicability. Changes in the conceptual design of the watch movement containing the mechanism will in most cases entail corresponding changes in the constant-force device, possibly involving technical difficulties and, most often, large expenses.

SUMMARY OF THE INVENTION

It is the aim of the present invention, therefore, to avoid these short-comings of current systems, and provide a constant-force device which because of its design concept is readily integrated into a lever escapement, both of a new watch and more particularly of an existing watch, too. This is to be realized while taking into account and utilizing elements present in the watch movement, in order to minimize space requirements for the device and technically optimize the device.

Therefore, it is an object of the present invention to provide a constant-force device for watches, and more particularly for wrist watches, having an indirect-second mechanism.

Further advantages will become evident from the characteristics expressed in the description which in the following will explain the invention in detail with the aid of the drawings.

More particularly because of its design concept, a constant-force device having these features is readily integrated into a lever escapement of new watches, and particularly of existing watches, having an indirect-second mechanism. By an appropriate arrangement of the components of the constant-force device, this integration can be realized with no changes, or with merely minor changes, in the existing watch movement or in the immediate neighborhood of the escapement.

It is possible in particular by using elements present in the existing watch movement, to reduce the number of parts required for the device, and thus to minimize the space requirements for the constant-force device.

By virtue of the favorable arrangement of the components of the constant-force device according to the present invention, the regulation of the amplitude of oscillations of the balance spring is also facilitated during assembly of the watch or in after-sales services.

By these provisions, therefore, a constant-force device can be realized that is flexible in its uses, easy to handle, space-saving, and relatively economic, and that more particularly can be integrated in watches of the type named, even a posteriori.

BRIEF DESCRIPTION OF THE DRAWINGS

By way of example, the appended figures show two embodiments of a constant-force device according to the present invention.

DESCRIPTION OF THE PREFERRED EMBODIMENTS

In the following, the invention will be described in detail while referring to the appended drawings representing by way of example several embodiments of the invention.

Figure 1B:
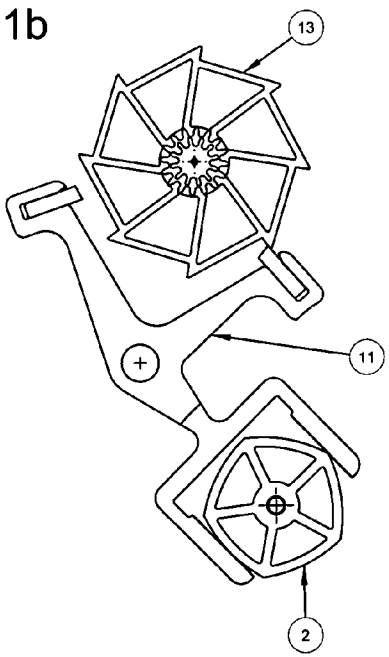
FIG. 1*b* is a detailed view of the device of FIG. 1*a* explaining how individual components of the constant-force device cooperate.
Figure 1A:
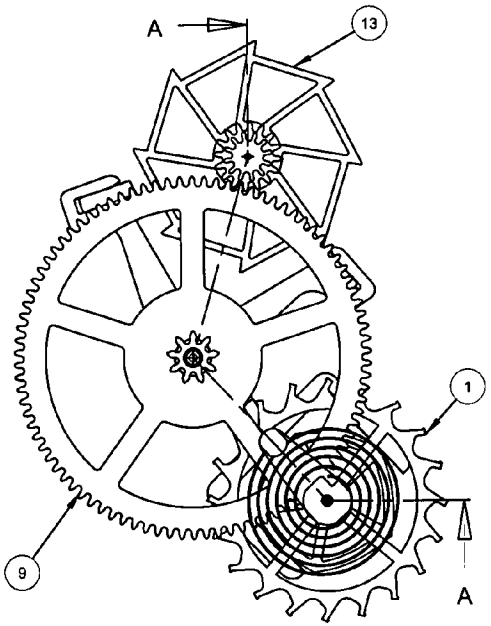
FIG. 1*a* represents a top view of a first embodiment of a constant-force device according to the present invention that has been integrated into a watch movement with indirect second.

FIG. 1*a* is a top view of a watch movement containing a first embodiment of a constant-force device according to the present invention that is adduced as an example, and where the escapement parts, seconds parts, and stopping parts and more particularly the advantageous arrangement of the components of the constant-force device are illustrated. Other components of the watch movement or wheel trains not contained in the description or in the figures are conventional and will not be explained in the following.

Figure 1C:
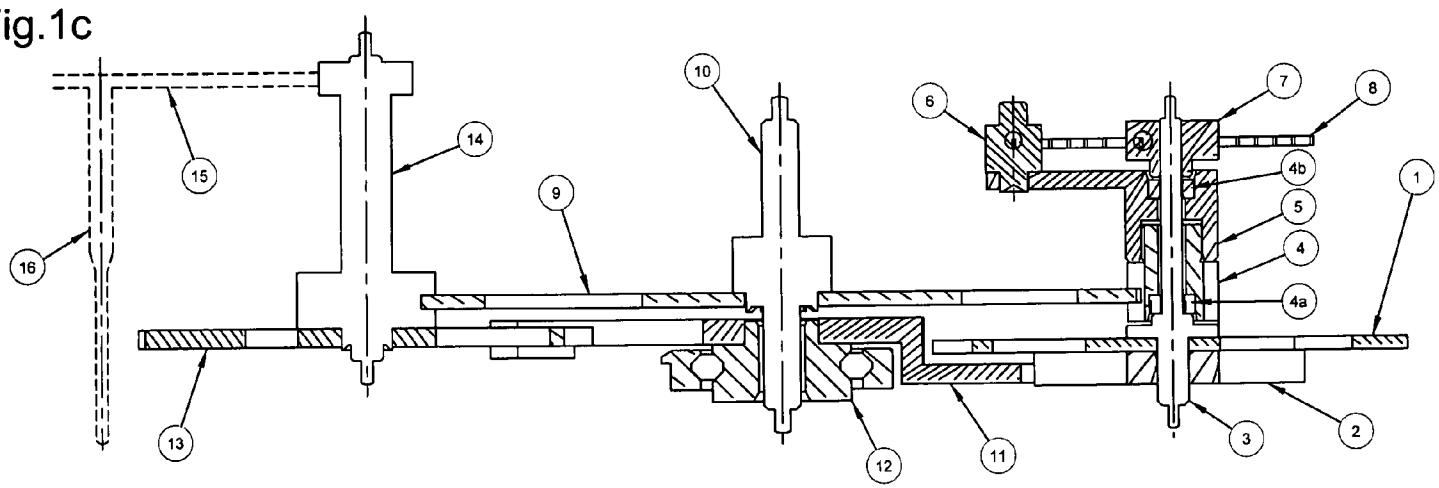
FIG. 1*c* is a section along line A—A of FIG. 1*a*.

The same device is represented in FIG. 1*c* as a sectional view along line A—A of FIG. 1*a*. One can see first of all the usual components of a watch movement in an arrangement similar to that in an indirect-second mechanism. Thus, an escape wheel 1 is mounted in the usual way on an escape wheel shaft 3, and likewise, a second wheel 9 is mounted on an associated second-wheel pinion 10. The second wheel 9 drives an intermediate second pinion 14 which in turn is engaged with an indirect-second wheel 15 mounted on the corresponding, indirect-second shaft 16. Any watch movement, be it a new movement or an existing movement, having this basic constellation can now be fitted with a constant-force device according to the present invention.

It should be noted at first at this point that a tensioning module of the constant-force device which conventionally consists of a tensioning-arm pinion 4, a tensioning arm 5, a stud 6, a collet 7, and a helical spring 8 can advantageously be mounted on the escape wheel shaft 3. In this case the tensioning-arm pinion 4 is mounted rotatably on the escape wheel shaft 3 in such a way, for instance by means of two rubies 4*a* and 4*b*, that this tension-arm pinion 4 engages with the second wheel 9. The tensioning arm 5 attached to the tensioning-arm pinion 4 carries the stud 6 to which the outer end of helical spring 8 is fastened. The inner end of this spring is fastened to the collet 7 which in turn is attached to the escape-wheel shaft 3, hence by a relative rotation of escape wheel 1 and second wheel 9, and thus of escape wheel 1 and tensioning-arm pinion 4, a tensioning of helical spring 8 can be produced. The collet 7 is preferably mounted on the side of the escape-wheel shaft 3 that is turned toward the bridge of the watch movement, so that the collet 7 is readily accessible and an adjustment of the amplitude of oscillations of the balance spring is readily possible without disassembly of the wheel train.

Normally, these elements are arranged on one side of the escape wheel 1, while a cam 2, in the present example with five sides, can be attached to the opposite side of the escape wheel 1 or, optionally, to the same side of the escape wheel 1 as the tensioning module.

This cam 2 cooperates with a fork of the lever 11 of the constant-force device, as can be seen more particularly from FIG. 1*b* illustrating the cooperation of the major components of the constant-force device. This lever 11 can advantageously be mounted rotatably on the second-wheel pinion 10 of second wheel 9, as shown in FIG. 1*c*, for instance with a ball bearing 12. This implies that, for instance in the case of an existing watch movement with an indirect-second mechanism, the existing arbor of second wheel 9 is elegantly used as the arbor for lever 11, and since an additional arbor is not needed, space is saved while integrating the constant-force device into the existing (or new) watch movement.

The lever pallets in turn, see FIG. 1*b*, conventionally cooperate with a stop wheel 13 of the constant-force device. According to FIG. 1*c*, it will be preferred here to mount this stop wheel 13, on one hand nonconcentrically with respect to escape wheel 1, and on the other hand more particularly onto the intermediate second pinion 14 mentioned above, in analogy to the unconventional arrangement of lever 11 on the second-wheel pinion 10.

Due to the nonconcentric arrangement of stop wheel 13 relative to the escape wheel 1, different gear ratios can be selected between the tensioning-arm pinion 9 and the second wheel 9 on one hand, and between the second wheel 9 and the stop-wheel pinion on the other hand (the latter being identical in the instant example with the intermediate second pinion 14). The rate of rotation of stop wheel 13 can then be optimized by reducing its moment of inertia.

By placing the stop wheel 13 onto the intermediate second pinion 14, moreover, the existing arbor of the intermediate second pinion 14 is used at once as the arbor for stop wheel 13, both in existing movements and in newly designed movements with an indirect-second mechanism. Stop wheel 13, therefore, is engaged with the second wheel 9 via the intermediate second pinion 14, and by omission of an additional arbor, space is saved and the integration of the constant-force-device into the watch movement is simplified.

In addition, stop wheel 13 will then be subject to the effects of torque of the second wheel 9, and is pushed against one of the pallets of lever 11 of the constant-force device This leads to a decrease in axial play of stop wheel 13, which in turn considerably reduces the play of the indirect-second wheel 15. In this arrangement of stop wheel 13, therefore, the friction spring can be omitted which generally is incorporated at the indirect-second wheel 15 in order to escape the consequences of play of this wheel, and this leads to a higher efficiency of the gear transmissions and a simplification of the watch movement.

The particular arrangement, on one hand of stop wheel 13 on the intermediate second pinion 14, and on the other hand of lever 11 on the second-wheel pinion 10 coaxially with the second wheel 9, therefore, serves to optimize the integration of a constant-force device into a watch movement having an indirect-second mechanism, particularly so with respect to an effective use of space, the use of existing elements of the movement for the purposes of the constant-force device, and a simplification of the resulting movement.

The functioning of a constant-force device that has been integrated in this manner into a movement with indirect second, basically corresponds to that of conventional devices, and in the following only a brief outline will be given in the instance of the watch movement sketched in the figures.

The tension of helical spring 8 which was mentioned above and which is placed on the escapement part guarantees that the oscillations of the regulating organ of the movement are maintaned. During each half oscillation of the regulating organ (which is not represented), escape wheel 1 rotates through a particular angle about its arbor, in the present example 9°. After a given number of half oscillations of the balance wheel, here after four half oscillations, that is, when the escape wheel 1 has performed a rotation of 36° about its arbor, the escape wheel 1 releases the stop wheel 13 via cam 2 that is attached to the escape-wheel shaft 3, and via the lever 11 of the constant-force device that is rotatably mounted on the second-wheel pinion 10 by means of ball bearing 12. The stop wheel then performs a rotation through an angle defined by the lever pallets, about its arbor, in the present example through an angle of 22.5°, this angle corresponding to the movement of the tooth of stop wheel 13 that rests on the entry pallet of lever 11, to the exit pallet of lever 11 after the release of stop wheel 13. The stop wheel 13 simultaneously drives the second wheel 9 as well as the indirect-second wheel 15 (which may for instance be located in the centre of the display) via the stop-wheel pinion (i.e., here the intermediate second pinion 14). In the given constellation, and with a frequency of 4 Hz of the regulating organ, second wheel 9 performs a jump every half second. The second wheel 9 further drives the tensioning arm 5 via the tensioning-arm pinion 4 that is rotatably mounted the escape-wheel shaft 3 and holds the tensioning arm 5, and thus it guarantees the retensioning of helical spring 8 of the constant-force device.

The number of teeth of escape-wheel shaft 3 and of the stop-wheel pinion, that is, in this case of the intermediate second pinion 14, is so selected that the retensioning angle of helical spring 8 during the given number of half oscillations, here four, is identical with the angle of rotation of escape wheel 1, in this example 36°. These values of the angles are mere examples, they can also be differently selected.

In general, the above frequency of the regulating organ or the number of teeth of the different wheels and number of sides of cam 2 that can be seen in the figures are not fixed, and can as well be differently selected. Depending on the selected frequency of the regulating organ, normally a particular configuration is of practical interest for the number of teeth of the different wheels as well as for the number of sides of cam 2, and will be used.

A second embodiment of a constant-force device according to the present invention is illustrated in FIGS. 2*a* to 2*d*.

In this case a constant-force device according to the invention is integrated into a chronograph mechanism. Here, FIGS. 2*a* to 2*c* correspond to FIGS. 1*a* to 1*c*, the corresponding explanations concerning construction and functioning of the constant-force device and of the movement, respectively, remaining valid for the present embodiment.

In this case, however, the intermediate second pinion 14 which in this case could also be called a chronograph intermediate pinion is realized as a tilted pinion. It can be seen from FIG. 2*c* that this pinion 14 in a first position I, normally vertical and corresponding to that of the first embodiment, drives the indirect-second wheel 15, which here could also be called a chronograph wheel. In a second position II, tilted, which can for instance be attained with a known pusher mechanism (not represented) of the chronograph, the chronograph wheel 15 will to the contrary be uncoupled and thus no longer be driven by second wheel 9 via the chronograph intermediate pinion 14.

Apart from the advantages cited in the description of the first embodiment, the additional advantage arises in the present case that one can avoid the sudden decrease in amplitude of the oscillations of the regulating organ which is caused by engagement of the chronograph mechanism when the constant-force device is used in combination with a chronograph mechanism. Because, so long as the torque at the second wheel 9 is higher than the torque required to retension the helical spring 8 of the constant-force device, the device will deliver a constant torque to the regulating organ, which results in an improved isochronism of the regulating organ.

Figures 2A, 2B, 2C, 2D:
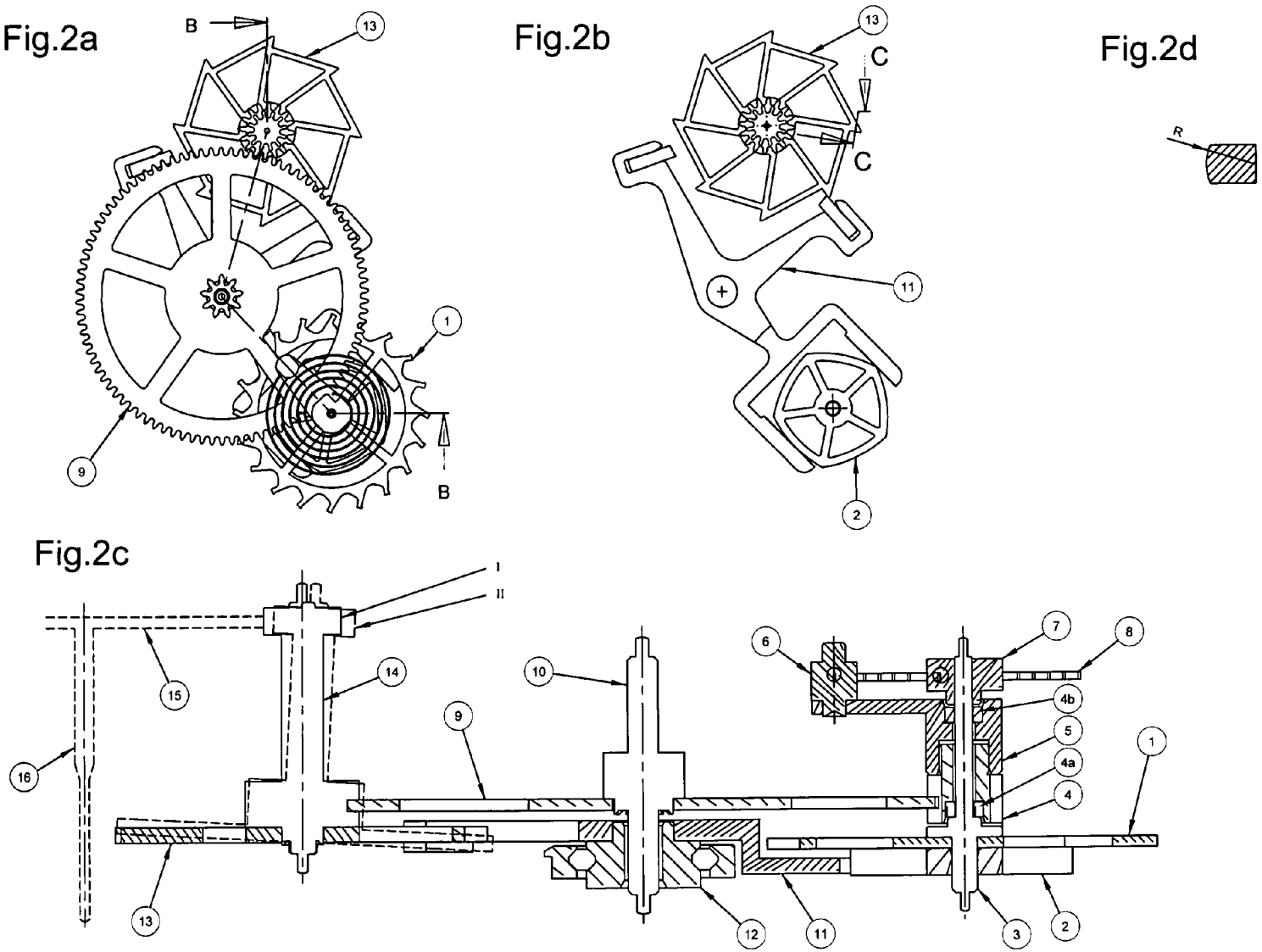
FIG. 2*a* represents a top view of a second embodiment of a constant-force device according to the present invention that has been integrated into a watch movement with indirect second.
FIG. 2*b* is a detailed view of the device of FIG. 2*a* explaining how individual components of the constant-force device cooperate.
FIG. 2*c* is a section along line B—B of FIG. 2*a*.
FIG. 2*d* is a section along line C—C of FIG. 2*b*.

In FIG. 2*d*, finally, a section of the teeth of an embodiment of stop wheel 13 that is preferred for this case is sketched. The teeth of stop wheel 13 have a section that is lightly rounded, as shown in this figure, and in harmony with the tilting motion of the chronograph pinion 14, in order to follow the tilting of the stop wheel when disengaging the chronograph mechanism.

In the embodiments of the present invention that have been described above, the integration of a constant-force device into a watch movement with an indirect-second mechanism is optimized by the particular arrangement, on one hand of stop wheel 13 on the intermediate second pinion 14 (i.e., by the fact that stop wheel 13 and intermediate second pinion 14 have the same arbor), and on the other hand of lever 11 coaxially to the second wheel 9 on the second-wheel pinion 10 (i.e., by the fact that second wheel 9 and lever 11 have the same arbor). This is particularly true with respect to the efficient use of space, to the use of existing elements of the movement for the purposes of the constant-force device, and to the simplification of the entire watch movement.

What is claimed is:

1. Constant-force device for a watch movement, comprising:

an intermediate second pinion (14) configured to drive an indirect-second wheel (15);

a second wheel engaged with the intermediate second pinion (14) to drive the intermediate second pinion (14);

a tensioning module (4, 5, 6, 7, 8);

a cam (2) operatively connected to the tensioning module;

a lever (11) cooperating with the cam (2); and a stop wheel (13) arranged on the intermediate second pinion (14) and engaging with the lever.

2. Constant-force device according to claim 1, characterized in that the arbor of lever (11) of the constant-force device is identical with the arbor of the second wheel (9) of the watch movement.

3. Constant-force device according to claim 1, characterized in that lever (11) is rotatably mounted by means of a ball bearing (12) onto a second-wheel pinion (10) carrying the second wheel (9).

4. Constant-force device according to claim 1, characterized in that the teeth of stop wheel (13) have a rounded section corresponding to a tilting motion of the intermediate second pinion (14) and of stop wheel (13).

5. Constant-force device according to claim 1, further comprising:

an escape wheel (1); and an escape-wheel shaft (3) carrying the escape wheel (1), wherein, the tensioning module comprises a tensioning-arm pinion (4) mounted on the escape-wheel shaft (3), a tensioning arm attached to the tensioning-arm pinion (4), a stud (6) carried by the tensioning arm (5), a collet (7) arranged around the escape wheel shaft (3), and a helical spring (8) fastening to the collet (7).

6. Constant-force device according to claim 5, characterized in that the tensioning-arm pinion (4) of the tensioning module which is mounted rotatably around the escape-wheel shaft (3) is engaged with the second wheel (9) of the movement, and that the collet (7) is attached to the escape-wheel shaft (3).

7. Constant-force device according to claim 1, characterized in that the cam (2) is mounted on an escape-wheel shaft (3) of the movement that carries an escape wheel (1).

8. Movement of a watch, comprising:

an indirect-second wheel shaft (16);

an indirect-second wheel (15) carried on the indirect-second wheel shaft (16);

an intermediate second pinion (14) engagable with the indirect-second wheel (15) for driving the indirect-second wheel (15);

a second wheel (9) engaged with the intermediate second pinion (14) to drive the intermediate second pinion (14);

a tensioning module (4, 5, 6, 7, 8);

a cam (2) operatively connected to the tensioning module;

a lever (11) cooperating with the cam (2); and a stop wheel (13) arranged on the intermediate second pinion (14) and engaging with the lever.

9. Movement according to claim 8, characterized in that the intermediate second pinion (14) is made tiltable in order to be able to realize a chronograph mechanism.

10. Movement according to claim 8, characterized in that in a first position (I) of the intermediate second pinion (14) the indirect-second wheel (15) is engaged with the intermediate second pinion (14), while in a second, tilted position (II) of the intermediate second pinion (14) the indirect-second wheel (15) is uncoupled from the intermediate second pinion (14).

11. Constant-force device for a watch movement, comprising:

a second-wheel pinion (10);

an intermediate second wheel (9) carried on the second-wheel pinion (10);

an intermediate second pinion (14), the intermediate second wheel (9) engaging with a pinion on the intermediate second pinion, the intermediate second pinion (14) being driven by the intermediate second wheel (9);

a stop wheel (13) arranged on the intermediate second pinion (14);

a tensioning module (4, 5, 6, 7, 8); a cam a lever (11) mounted on the second wheel pinion (10) and cooperating with the cam, the stop wheel (13) engaging with the lever (11).

* * * * *